United States Patent [19]

Palifka

[11] 3,968,751

[45] July 13, 1976

[54] ARMING DEVICE

[75] Inventor: Robert G. Palifka, Orford, N.H.

[73] Assignee: The United States of America as represented by the Secretary of the Navy, Washington, D.C.

[22] Filed: Sept. 5, 1975

[21] Appl. No.: 610,601

[52] U.S. Cl. ..... 102/76 R
[51] Int. Cl.[2] ..... F42C 5/00
[58] Field of Search ..... 102/81, 83, 84, 76; 267/164, 173

[56] References Cited

UNITED STATES PATENTS

| | | | |
|---|---|---|---|
| 2,296,175 | 9/1942 | Morkoski | 267/173 X |
| 2,446,545 | 8/1948 | McCaslin | 102/80 |
| 3,362,333 | 1/1968 | Czajkowski et al. | 102/81 |
| 3,367,265 | 2/1968 | Sewell | 102/81 |
| 3,421,442 | 1/1969 | St. Clair | 102/81 X |
| 3,938,443 | 2/1976 | Wolski | 102/81 X |

*Primary Examiner*—David H. Brown
*Attorney, Agent, or Firm*—R. S. Sciascia; Roy Miller; Gerald F. Baker

[57] ABSTRACT

A logic module system utilizing a spring energy storage means having a specific threshold level response and a constant force over a specific displacement in cooperation with a plurality of cams adapted to be moved by external forces, such as ram-air pistons, rate controlled springs, or the like. Each individual cam is profiled to present a control surface to a cooperating plunger at specified time intervals or "windows." If the combined control surfaces present at any instant in time correspond to a predetermined sequence, the system will move to an ARM condition. Absent the proper arrangement of the "windows," the system will be returned and locked in a SAFE condition.

3 Claims, 4 Drawing Figures

ARMING DEVICE

CROSS REFERENCE TO RELATED APPLICATIONS

The present invention is usable in the gating system described in Assignee's prior application Ser. No. 467,173 filed May 6, 1974 now U.S. Pat. No. 3,878,766, and is a variation of Assignee's prior application Ser. No. 479,936 filed June 17, 1974, now U.S. Pat. No. 3,938,443.

BACKGROUND OF THE INVENTION

The system utilizing the present invention is designed to control and program the operation of several mechanical elements in a predetermined manner or sequence for arming an aerial delivered weapon, for example.

More particularly, the system described is designed to position a missile fuze device in an ARMED condition or in a deactivated (DUD) or SAFE condition depending upon the sequence of operations sensed by the weapon fuze.

When a missile is carried by an aircraft, for example, there is always the possibility that the aircraft will crash on takeoff or that the missile will otherwise be dislodged inadvertently from the aircraft. In such cases, if the missile fuze is so constructed that the departure from the aircraft will cause an ARMED condition, any loose missile will be highly dangerous. It is considered advantageous, therefore, to employ a fuze which must sense, or otherwise be dependent upon, several factors happening in a particular order before the missile will be ARMED.

SUMMARY OF THE INVENTION

According to the present invention, a device is provided which is dependent on the sequence of events or environmental conditions experienced by a SAFE and ARM system and the motion of an arming plunger locks the system in the SAFE and ARM condition or deactivated (DUD) condition dependent upon the time of sensing and the presence or absence of sensing or the occurrence or non-occurrence of an environmental phenomenon.

In other words, if the right combination of events are sensed in the proper sequence, the system moves from the SAFE to the ARM condition. However, if the control surface profiles of various cams moved as a result of the events are improperly presented in timed sequence or not presented at all, the status of the device goes to a locked deactivated (DUD) condition in which the missile can be safely defuzed.

DESCRIPTION AND OPERATION

Figure 1:
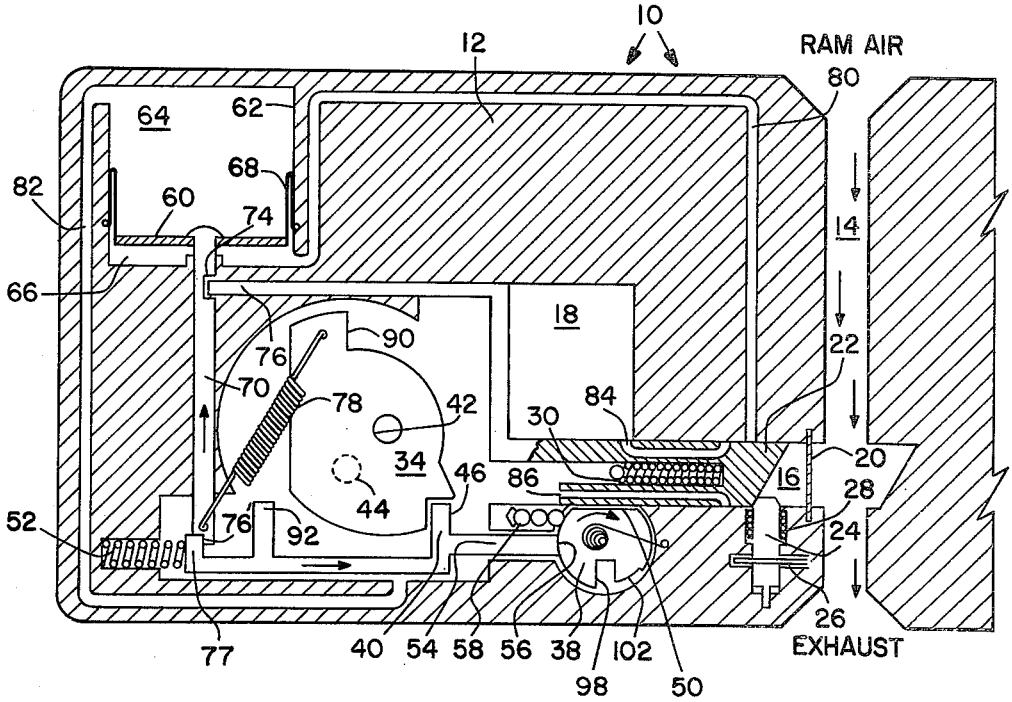
FIG. 1 is a schematic diagram of a fuze mechanism utilizing a logic module system according to the present invention showing the device in the SAFE position prior to launch.

Shown generally at 10 in FIG. 1 is a schematic representation of a missile fuze, for example, designed to use the logic module system according to the invention.

The fuze consists of a housing 12 having an air passageway or duct 14 passing therethrough. The housing 12 is arranged in the missile such that one end of passageway 14 is in a high pressure area or is furnished with ram-air while the other end is in a low pressure area or exhaust. A second passageway or gate valve chamber 16 is located orthogonal to the duct 14 and communicates with an inner chamber 18 containing the elements of the logic module system. During storage and at all times before operational flight of the missile, chamber 18 is hermetically sealed from air in duct 14 by means of a seal 20 of soft metal or the like across passageway 16.

The seal 20 is designed to be cut by gating valve member 22 which is closely fitted for sliding movement within valve chamber 16. This gating member 22 is held in an inactive position by means of a stop member 24 which is, in turn, locked in place by an arming wire 26. Stop member 24 is biased by a spring 28 to a position free of interference with the movement of gating member 22 and the gating member is biased toward an actuated position by means of spring 30.

Within the fuze chamber 18 there are a rotor 34 and a timer 38, and a plunger 40 cooperating with cam surfaces on the rotor and timer.

Rotor 34 carries a primer in an opening 42 provided therein which is out of line with the detonation train indicated by the dotted circle at 44. In the position shown, rotor 34 is locked by a cam 46 on plunger 40 and the timer cam 38 is locked by the cooperation of a flattened portion 50 with the gating member 22.

Plunger 40 is urged by a spring 52 toward a position unlocking rotor 34. Movement of plunger 40 from the position shown is prevented however, by the end 54 of plunger 40 resting on the cam surface 56 of timer 38. The timer 38 is urged in the direction of the arrow by a spring motor (not shown) and the rate of travel is controlled through a gear train and escapement mechanism 58 in a well known manner.

The environmental sensor in the illustrated embodiment is a fluid motor consisting of a piston 60 confined in the cylinder 62 and dividing the cylinder into two chambers 64, 66. Piston 60 is shown sealed to the wall of piston 62 by means of a rolling rubber diaphragm 68. Any differential pressure between chambers 64 and 66 will tend to move the piston 60 and a piston shaft 70 is attached to piston 60 to transfer the energy from piston 60 to an energy storage spring 78. Shaft 70 is provided with a cutout portion 74 which in the position shown cooperates with an extension 76 of gate 22 and a cutout portion 76' cooperating with a tab 77 on plunger 40. With this arrangement, it is necessary for shaft 70 to move upward in the direction of the arrow in order for the plunger 40 to move. Before the shaft 70 can move, however, the extension 76 of gate 22 must have moved from its position in notch 74 of shaft 70.

Figure 2:
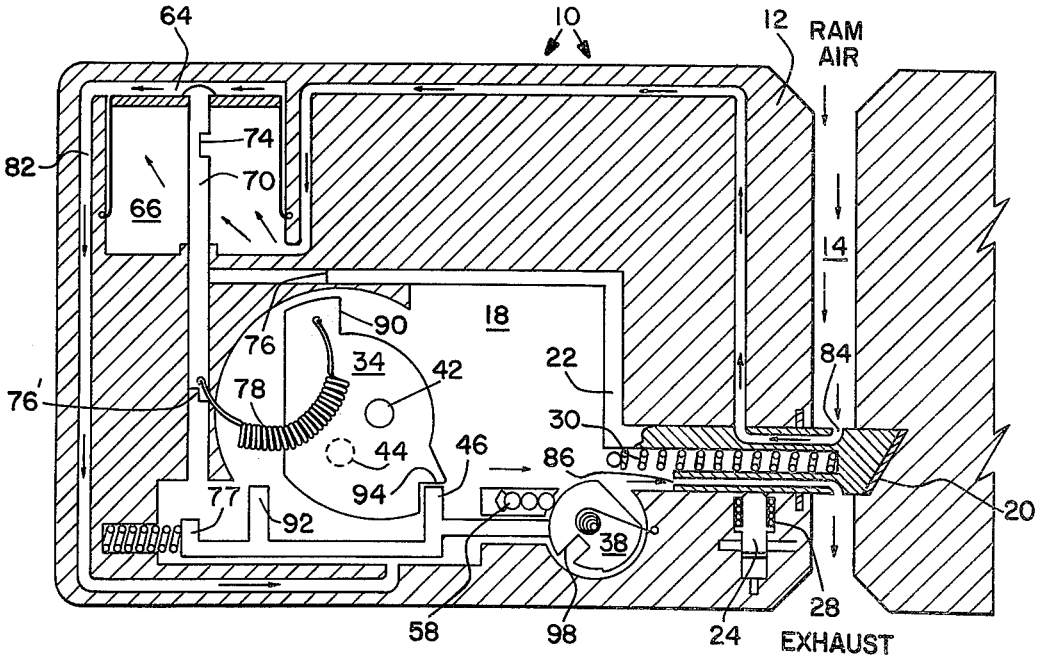
FIG. 2 is a view similar to FIG. 1 wherein the weapon has been launched and the timer is running.

Movement of shaft 70 upward in the direction of the arrow will store energy in the operating spring as shown in FIG. 2. Energy to move rotor 34 from its position of rest as shown in FIG. 1 to the position shown in FIG. 2 is derived only by storage of energy in spring 78. This energy, however, remains stored until rotor 34 is able to move by movement of plunger 40 which in turn is allowed only after sufficient movement of clock cam 38.

Differential pressure between chamber 64 and 66 of environmental sensor 32 is accomplished by the introduction of fluid into and the exhaust of fluid from respective sides of piston 60 through passageways 80 and 82. This can only be accomplished when the gate member 22 has been moved to the position shown in FIG. 2. The two passageways 84, 86 in the gate member 22 are sealed against the walls of chamber 16 when the gating member is in the position shown in FIG. 1. Rotor 34, and clock cam 38 have further locking surfaces 90, 98, and 102, the purpose of which will appear in the description of FIG. 2.

In the position shown in FIG. 2, the arming wire 26 has been removed allowing the detent 24 to move out of the way of gate 22 and gate 22 has moved to the right puncturing seal 20. This action has created a path through body 12 for air to enter the chamber 66 and for air to leave chamber 64. Differential pressure, therefore, has caused the piston 60 to rise in cylinder 62. Cylinder 60 is allowed to rise under these circumstances because the end of extension 76 has been removed from notch 74 in shaft 70. Movement of shaft 70 upward has caused a flexing of spring 78 and rotor 34 is now biased in a clockwise direction. The clock is running and plunger 40 has been released also by shaft 70 and can enter the slot 98 on timer cam 38 at the expiration of the set time.

Figure 3:
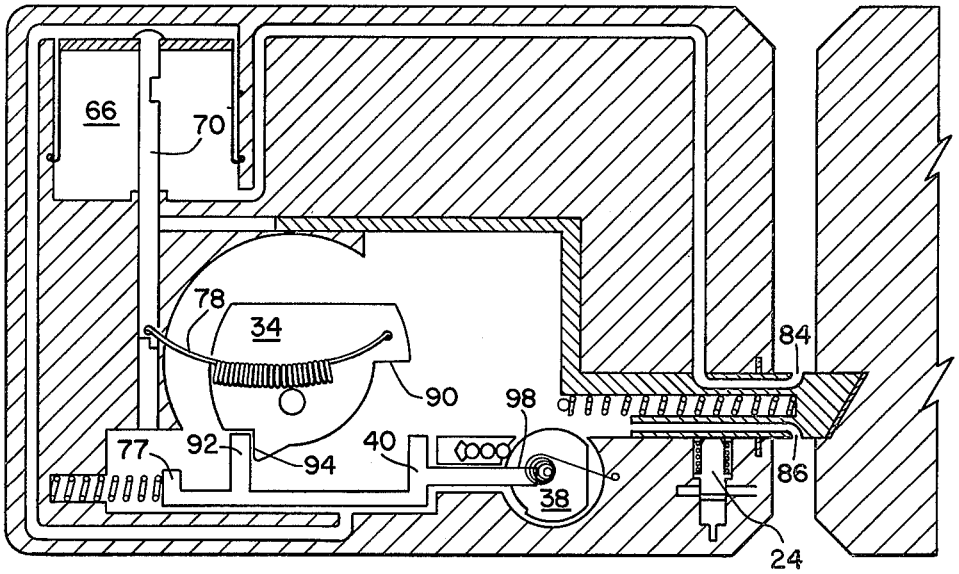
FIG. 3 is a view similar to FIG. 1 with the system in the ARMED condition.

As shown in FIG. 3 the clock has run a sufficient time to allow plunger 40 to enter slot 98, the rotor 34 has been unlocked and has been rotated clockwise under the influence of spring 78. In this position rotor 34 is again locked in position by a tab 92 on plunger 40 which cooperates with the surface 94 of the rotor. In this position the system is locked in an ARMED condition and can be fired on command.

Figure 4:
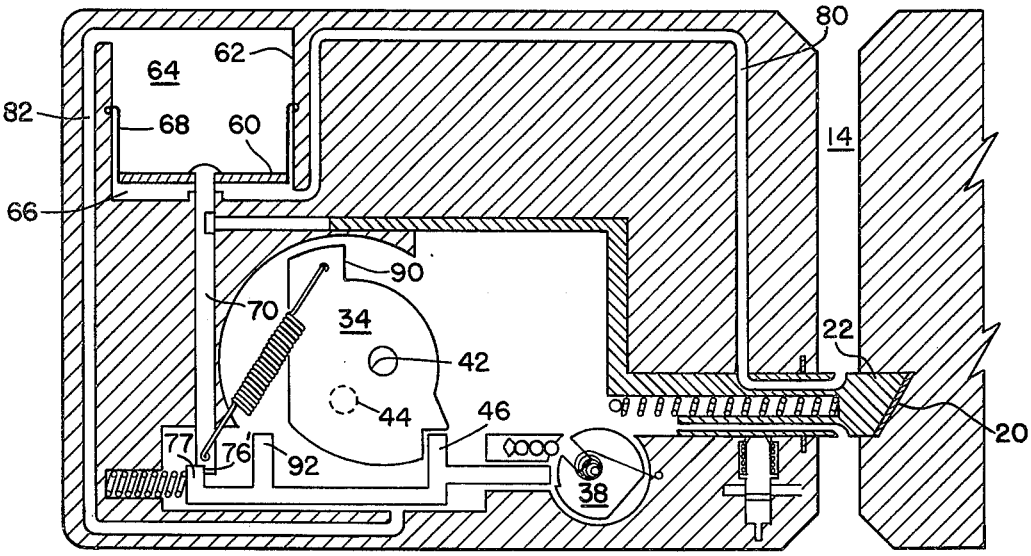
FIG. 4 is a view similar to FIG. 1 wherein the system is in the SAFE/DUD condition.

After the arming wire is pulled, should the clock overrun as shown in the FIG. 4, the plunger 40 cannot travel far enough to the right to allow rotor 34 to be turned. The clock will always overrun to this position when insufficient air pressure has been encountered to stroke the piston 60 and remove the end of shaft 70 from the tab on plunger 40. Because of the cooperation necessary between the clock timer and the air pressure sensing device, conditions which do not indicate that the weapon or missile has been properly fired will result in the locked SAFE condition shown in FIG. 4.

The arming spring 78 is preferably a Flex'ator spring manufactured by Hunter Spring Company, Lindsdale, Pennsylvania. The spring illustrated provides a specific threshold level response and a constant force over a specified displacement giving stored spring energy to activate the arming rotor or to restore the shaft 70 to its original position. The application of a threshold force is required to cause the spring to flex. In this flexed position, the spring stores energy and is held in position by the application of a constant force matched by the stored spring energy. When the stored energy in the spring is released by the unlocking of rotor 34, the energy is released over a specified displacement with sufficient constant force to cause positive rotation of arming rotor 34.

What is claimed is:

1. In a control mechanism including:

environmental sensing means having an energy output;

actuation initiation means;

time delay means;

first, second and third cam means movable from an initial position to a final actuation position;

plunger means coacting with said cam means and movable from an initial position blocking movement of said third cam means;

said first cam means being driven under control of said time delay means from an initial position blocking movement of said plunger means to an actuation position allowing finite travel of said plunger means;

said second cam means being driven by energy developed by said environmental sensing means from an initial position blocking movement of said plunger means to an actuation position allowing full travel of said plunger means;

said third cam means carrying said actuation initiation means and being connected to said second cam means through an energy storage means;

said plunger means blocking movement of said third cam means until energy has been stored in said energy storage means;

whereby, when said first and second cam means move into the actuated position, said plunger means will move into a position unlocking said third cam means and allowing said third cam means to move into the actuation initiation position; the improvement comprising:

said energy storage means connecting said second and third cam means consisting of a compression spring having a predetermined threshold level response and supplying a constant force over the displacement range of said second cam means;

whereby energy is stored in said spring upon movement of said second cam means in response to said environmental sensing means; and said force being sufficient to move said third cam means when unlocked to actuation initiation position; or to move said second cam means back into a position locking said plunger means when said energy developed by said environmental sensing means falls below a predetermined value.

2. The control mechanism of claim 1 further including:

said first cam means being provided with a notch commensurate with the forward end of said plunger means; and said second cam means having a relieved initial portion;

whereby, in the event the first cam means is moved prior to movement of said second cam means, the plunger means enters said slot preventing further operation of said mechanism.

3. The control mechanism of claim 1 further including:

said first cam means being provided with an overrun control surface coacting with a forward end of said plunger means and effective therewith to block actuation in the event movement of said first cam means precedes movement of said second cam means by a finite amount.

* * * * *